United States Patent [19]

Fox et al.

[11] Patent Number: 4,711,066

[45] Date of Patent: Dec. 8, 1987

[54] METHOD AND APPARATUS FOR PACKAGING MEDICAL GAUZE SPONGES

[75] Inventors: Lester A. Fox; Paul E. Zielinski, both of Augusta, Ga.

[73] Assignee: The Surgimach Corporation, Augusta, Ga.

[21] Appl. No.: 905,130

[22] Filed: Sep. 9, 1986

[51] Int. Cl.[4] ..... B65B 9/02; B65B 35/50; B65B 63/02

[52] U.S. Cl. ..... 53/436; 53/447; 53/450; 53/451; 53/526; 53/528; 53/540; 53/554

[58] Field of Search ..... 53/542, 540, 532, 554, 53/242, 243, 526, 451, 450, 436, 439, 447, 528, 247

[56] References Cited

U.S. PATENT DOCUMENTS

| | | | |
|---|---|---|---|
| 2,328,814 | 9/1943 | Laukhuff | 53/425 |
| 2,826,025 | 3/1958 | Swartz | 53/554 |
| 2,869,297 | 1/1959 | Neer | 53/243 X |
| 2,871,639 | 2/1959 | Forgo | 53/554 |
| 3,054,517 | 9/1962 | Nicol | 53/425 |
| 3,370,397 | 2/1968 | Brigman | 53/554 |
| 3,478,870 | 11/1969 | Segel | 53/554 X |
| 3,991,540 | 11/1976 | Ballestrazzi et al. | 53/554 X |
| 4,162,870 | 7/1979 | Storm | 53/542 X |
| 4,179,867 | 12/1979 | Bodolay | 53/425 |
| 4,398,383 | 8/1983 | Prakken | 53/542 X |

*Primary Examiner*—Horace M. Culver
*Attorney, Agent, or Firm*—Laurence R. Brown

[57] ABSTRACT

The present disclosure is directed to a method and apparatus for packaging sanitary medical sponges which are deformable articles of a shape generally disposed in a flat plane with a stacked array thereof contained between two webs of packaging material, wherein the sponges are formed on a machine, they are delivered in a fixed number of at least two sponges from the machine in a stacked array with the planes of the sponges vertically disposed in a side-by-side relationship. Two webs of the packaging material are converged into a substantially V-shaped vertically disposed reception slot adapted to receive the stacked array of sponges. They are dropped into a reception slot so that the stacked array is substantially wedged therebetween. The webs of packaging material are synchronously moved a distance toward the slot to form a pocket between the webs as the stacked array is received thereinto for moving the stacked array away from said slot and for containing and packaging the stacked array and stopping the webs to receive a further stacked array between the webs. The webs are sealed about the stacked array of sponges to form a package and the packages are separated from the web between stacked arrays to form individual packages.

11 Claims, 7 Drawing Figures

METHOD AND APPARATUS FOR PACKAGING MEDICAL GAUZE SPONGES

TECHINCAL FIELD

Our invention is directed to the art of packaging arrays of medical sponges packed in an array of two sponges per package unit.

This machine may be employed by itself or combined with a surgical sponge making machine for producing packages of multiple sponges without disturbing the exact geometric perimeter alignment between adjacent sponges so that all portions of the flat surfaces of each sponge are in alignment with each adjacent sponge to avoid overlapping while producing sealed packages of medical gauze sponges.

Our invention relates to a method and apparatus for packaging arrays of medical sponges into individual packages. The problems extant in the art arises due to the fact that the sponges are not rigid and although being flat, due to their surface gauze-like texture and their being deformable especially when in adjacent physical contact with one another they are difficult to handle. This is true whether they are placed in a vertical or horizontal position. When two surgical sponges of the same physical width, length and thickness are placed against one another in exact registry as to their perimeters and attempt is made to wrap them what generally happens is that due to excessive handling in the wrapping phase relative slippage between the two sponges occurs and it is extremely difficult to establish realignment for packaging. We have found by employing a collector box having a trap door that when the box is fed by the lay up paddle receiving the sponges from the discharge chutes or trays of the sponge making machine, that by dropping both sponges simultaneously vertically into a substantially V-shaped vertically disposed reception slot between webs of packaging paper the alignment of the two sponges in adjacent contact with one another is preserved. This is not true when attempting to insert two sponges horizontally into a V-shaped packet of packaging material.

While we have used the term sterile gauze sponges this is intended to not be limited to surgical gauze sponges but also includes, cellulose, non-woven and hydro-entangled or similar type sponges.

BACKGROUND ART

Heretofore many forms of surgical sponge making machines have been known for example, U.S. Pat. Nos. 2,328,814 and 3,054,517 and packaging machines such as U.S. Pat. No. 4,179,867 but we are not aware of a sponge packaging machine that has been combined and indexed with the output of a sponge making macine.

DISCLOSURE OF THE INVENTION

In accordance with our invention, we provide a packaging machine adapted to be placed at the discharge end of a medical sponge making machine and aligned with the sponge making machine discharge chute or conveyor. The packaging machine is indexed with the output of the manufacturing machine to pick up sponges therefrom and deliver a fixed number of sponges, at least two sponges, in a stacked array at a pickup station. The planes of the sponges are vertically disposed in a side-by-side relationship above two converging webs of packaging material. The packaging material converges into a substantially V-shaped vertically disposed reception slot beneath the pickup station. The array of sponges are then dropped into the reception slot or pocket so that the stacked array of sponges are wedged between the two webs in a pocket of packaging material without disturbing their exact side-by-side and end-to-end flat registry. Thereafter, the webs of packaging material containing the perfectly aligned array of sponges in the pocket are moved away from the drop point of the sponges and the packaging material under control of a scanner is stopped when a new reception slot or pocket is formed to receive another array of sponges. The first array of sponges surrounded by packaging material has now arrived at the sealing station where the packaging material is sealed about the sponges to form a series of connected packages of medical sponges. After the sealing has been effected the packaging machine is again indexed to transfer the web of packaging material and the sealed array of sponges to a separating station where the individual packages of sponge arrays are cut from the line of sealed packages into individual packages.

The construction of our combined medical sponge making machine and packaging machine make it possible for one attendant to service, load and unload six such machines which heretofore required one person for each two machines.

Our machine provides a more sanitary handling of medical sponges from making to packaging so that none of the packaged medical sponges have to be handled by hand with resultant contamination.

BRIEF DESCRIPTION OF THE FIGURES OF DRAWINGS

THE BEST MODE FOR CARRYING OUT THE INVENTION

Figure 1:
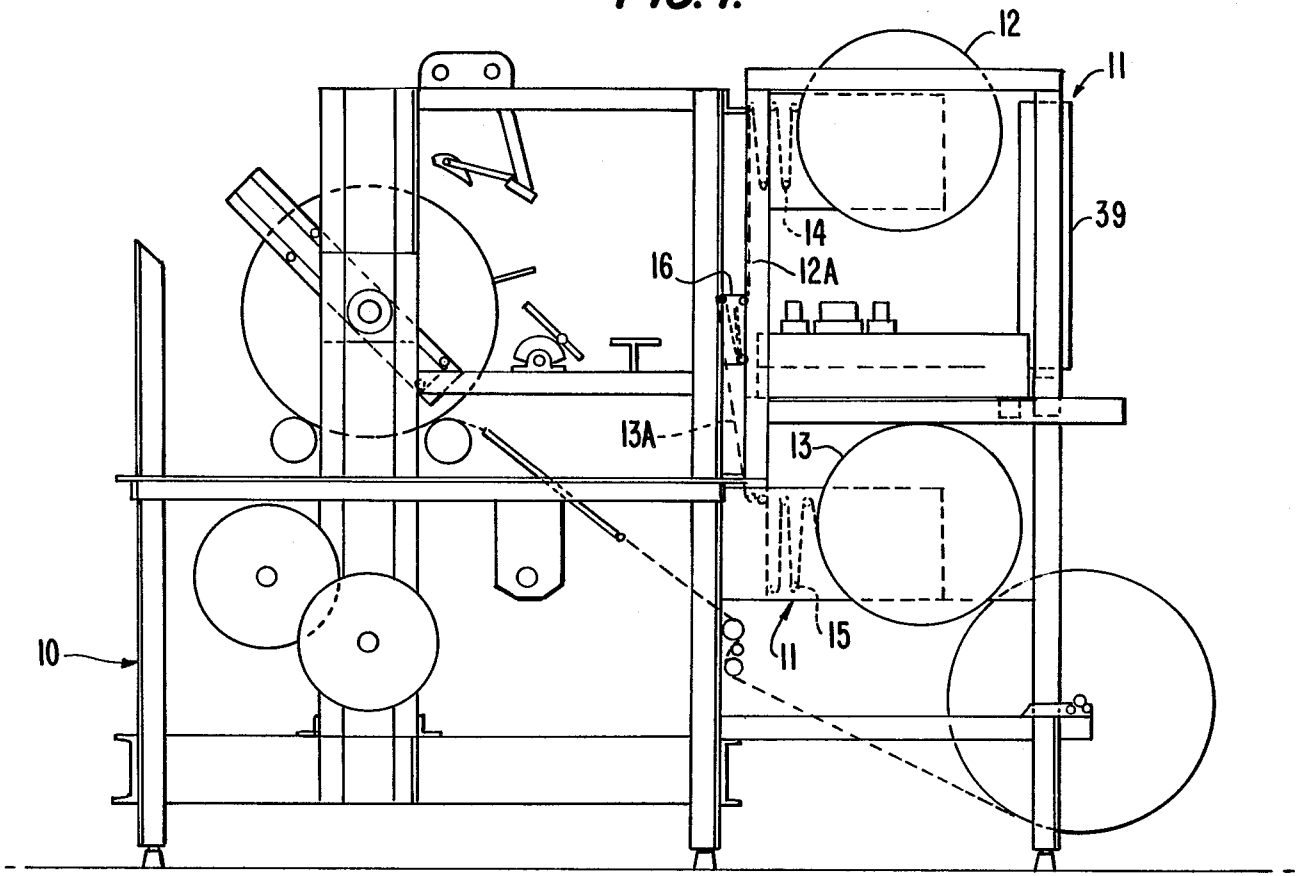
FIG. 1 is a side elevational view of a medical sponge making machine attached to a packaging machine constructed in accordance with the present invention.

Referring now to the drawings and for the moment to FIG. 1, 10 designates a medical sponge making machine of the type shown and described in the Alfred Laukhuff U.S. Pat. No. 2,328,814 or the Herbert E. Nicol U.S. Pat. No. 3,054,517, and 11 designates the new sponge packaging machine of my invention shown attached thereto.

Figure 2:
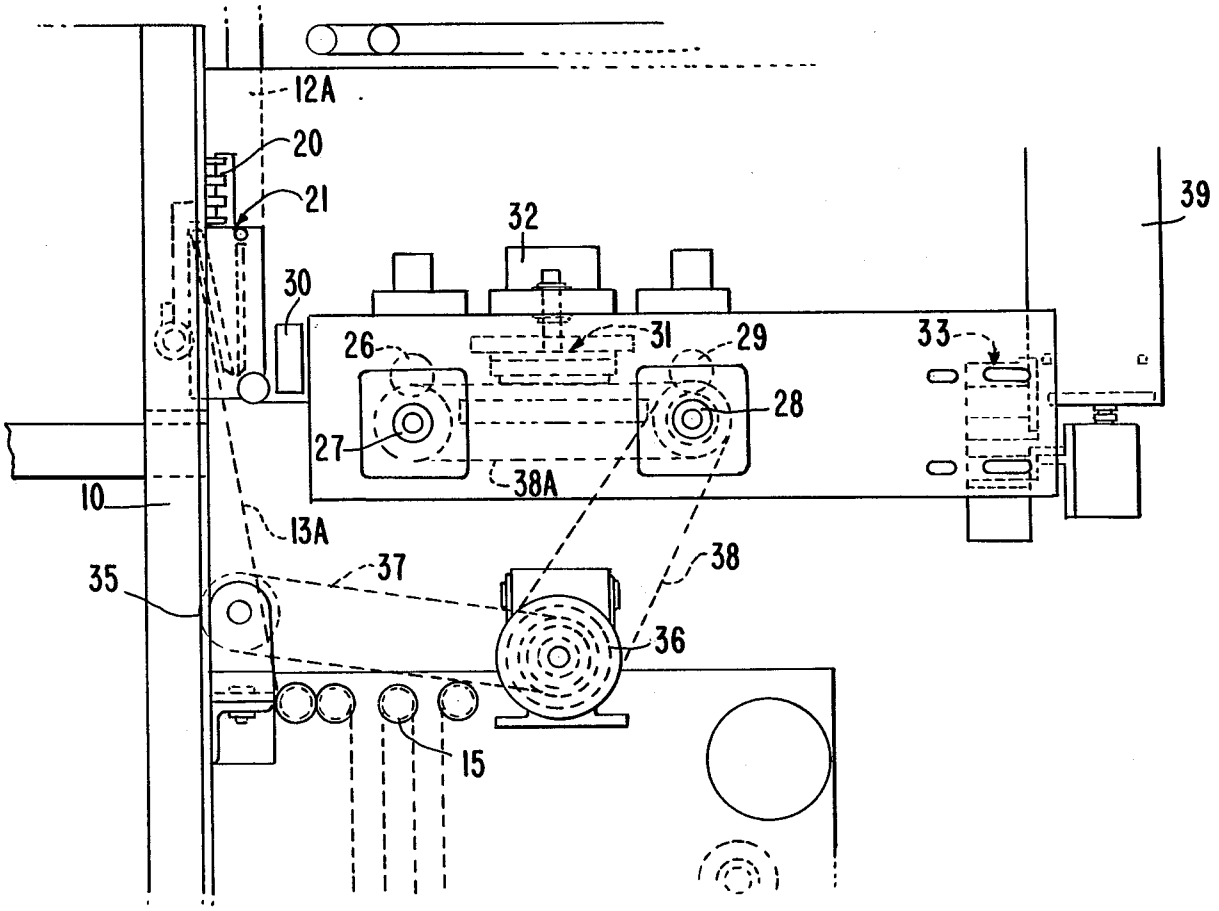
FIG. 2 is a magnified side elevational view of the packaging machine of the present invention with parts shown in dash line.
Figure 4:
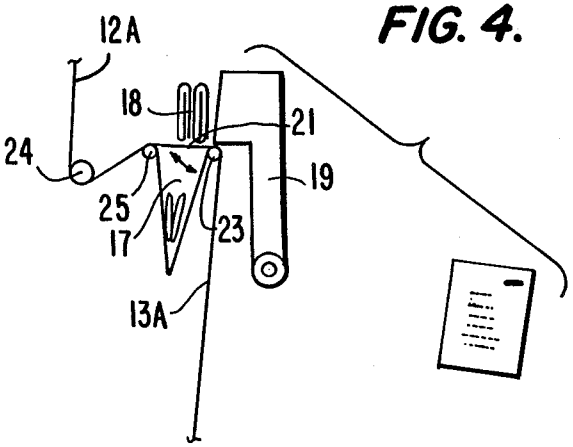
FIG. 4 is an enlarged schematic of the collecting station and V-shaped pocket of the package former.
Figure 3:
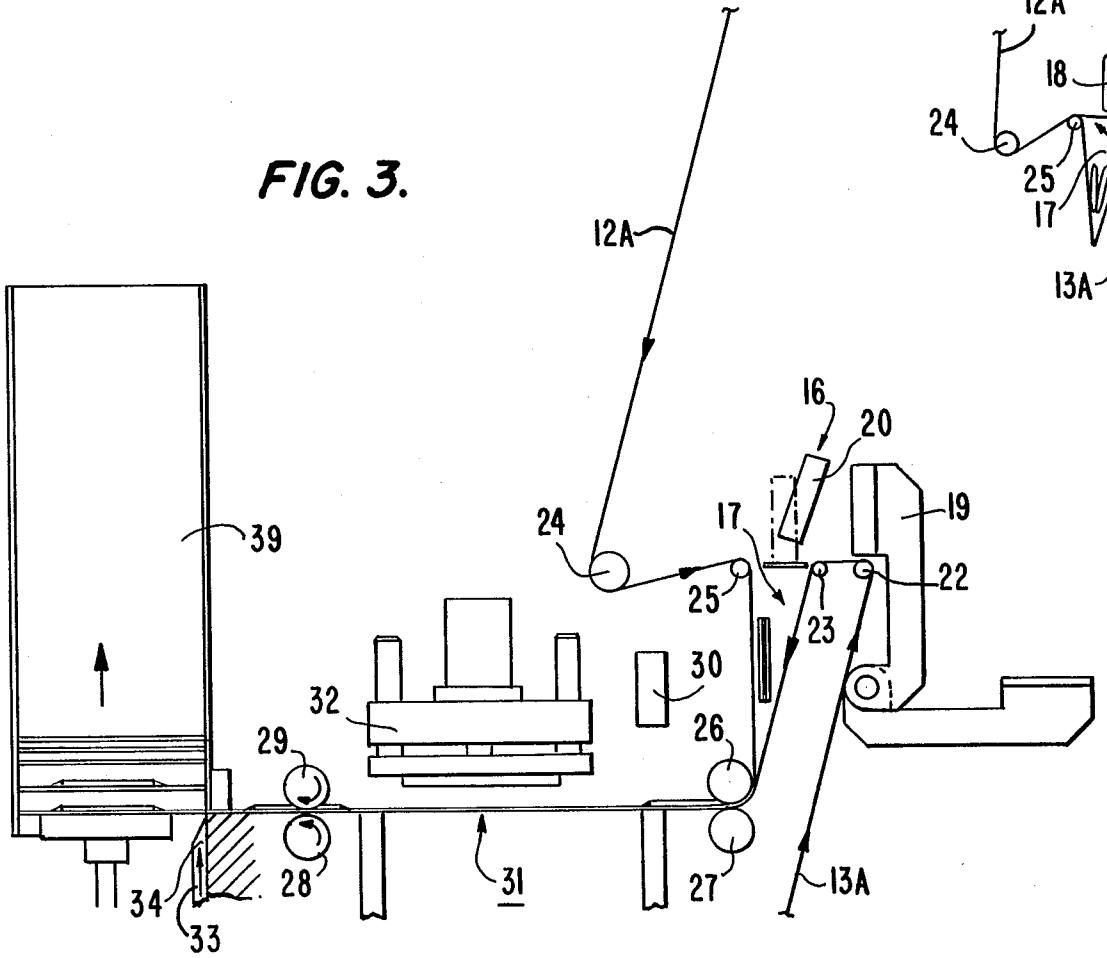
FIG. 3 is a schematic of the collecting station, package V-former, pull rolls, scanner, sealing station, cutting station and stacking box or package tray.

As best seen in FIGS. 1 and 2, the packaging machine 11 is provided with an upper roll 12 and a lower roll 13 of packaging material. The packaging material coming off roll 12 passes over tensioning rolls 14 and the material coming off of roll 13 passes over tensioning rolls 15. The packaging material from the two rolls at the collecting station 16 where as best seen in FIGS. 3 and 4, the V-shaped slot or pocket 17 for receiving a plurality of sponges 18 to be packaged is formed. A pivoted driven rocker lay up arm 19 receives sponges 18 from the sponge making machine 10 and lays the sponges into a collector box 20 which may be pivoted or stationary having a trap door 21 which is driven between an opened and closed position by an electrically timed actuator. As best seen in FIGS. 3 and 4 the packaging material 13A from the lower paper roll 13 passes over rolls 22, 23 while packaging material 12A from the upper paper roll 12 passes over rolls 24, 25 and both enter between feed pull rolls 26, 27. Between rolls 23, 25 and rolls 26, 27, the package V slot or pocket 17 is formed which receives the array of sponges 18 to be packaged from the collector box 20 when the trap door 21 is opened discharging the sponges. The trap door is then closed, the lay up arm 19 recharges the collector box 20 with sponges and feed pull rolls 26, 27 and 28, 29 are pressurized and driven pulling the web of packaging material and sponges therebetween horizontally across the packaging machine beneath the scanner 30 which will signal when an array of sponges 18 between the web of packaging material is in registry with the sealing station 31 and the sealing platen 32 will be closed forming a containment seal about the array of sponges. When the trap door 21 has released another array of sponges into the pocket 17 between the two webs of packaging material and has closed, the feed pull rolls 26, 27 and 28, 29, upon opening of the sealing platen 32, will be pressurized and driven to pull the webs of packaging material from right to left in FIG. 3, and left to right in FIG. 2 so that the packaged arrays of sponges 18 are placed at the shearing or cutting station 33, where a guillotine knife 34 cuts through the web and separates the arrays of sponges into individual packages containing two sponges each, which are fed to a stacking tray 39 for collecting sealed packages of sponges.

PACKAGING MACHINE DRIVE

As best seen in FIG. 2, lower left-hand side, the sponge making machine 10 has a drive take-off 35 which drives a clutch/brake mechanism 36 through belt 37. The clutch/brake mechanism 36 in turn drives the pull feed rolls 28, 29 through belt drive 38 which drives feed pull rolls 26, 28 which in turn drives through belt 38A which drives or pulls the two webs of packaging material 12A, 13A coming from the upper and lower rolls 12 and 13, respectively.

Figure 5:
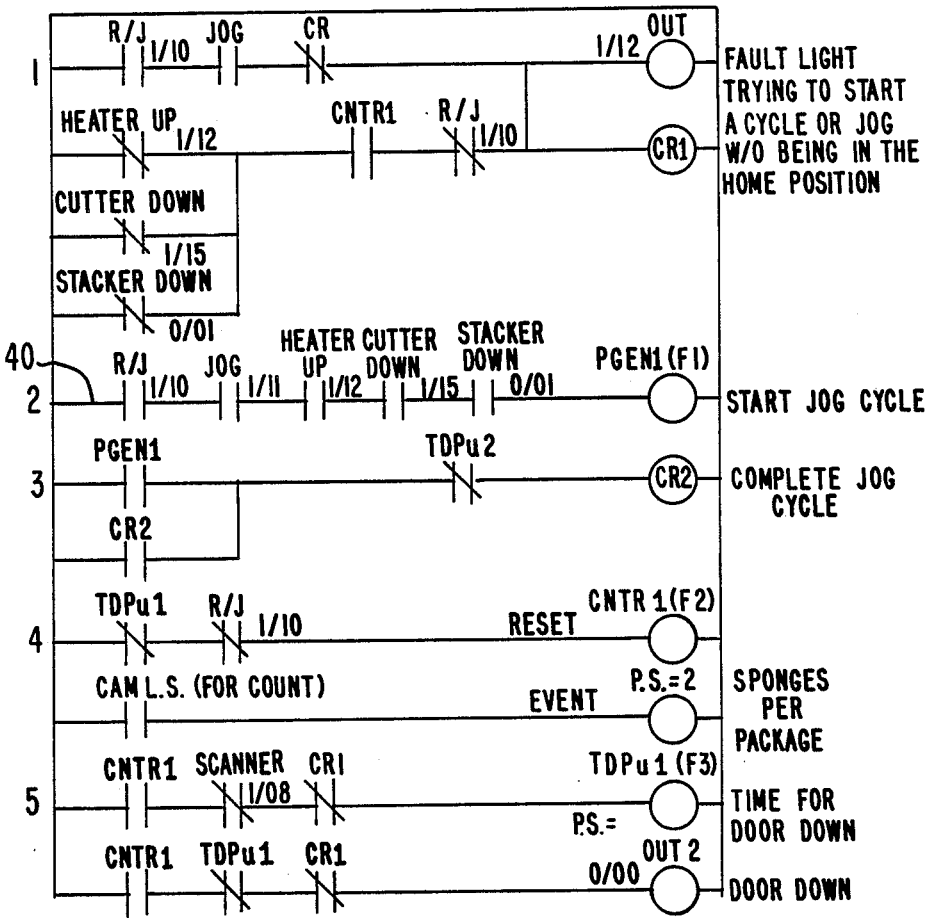
FIGS. 5 through 7 are electrical schematic ladder diagrams of the packaging machine of the present invention.
Figure 6:
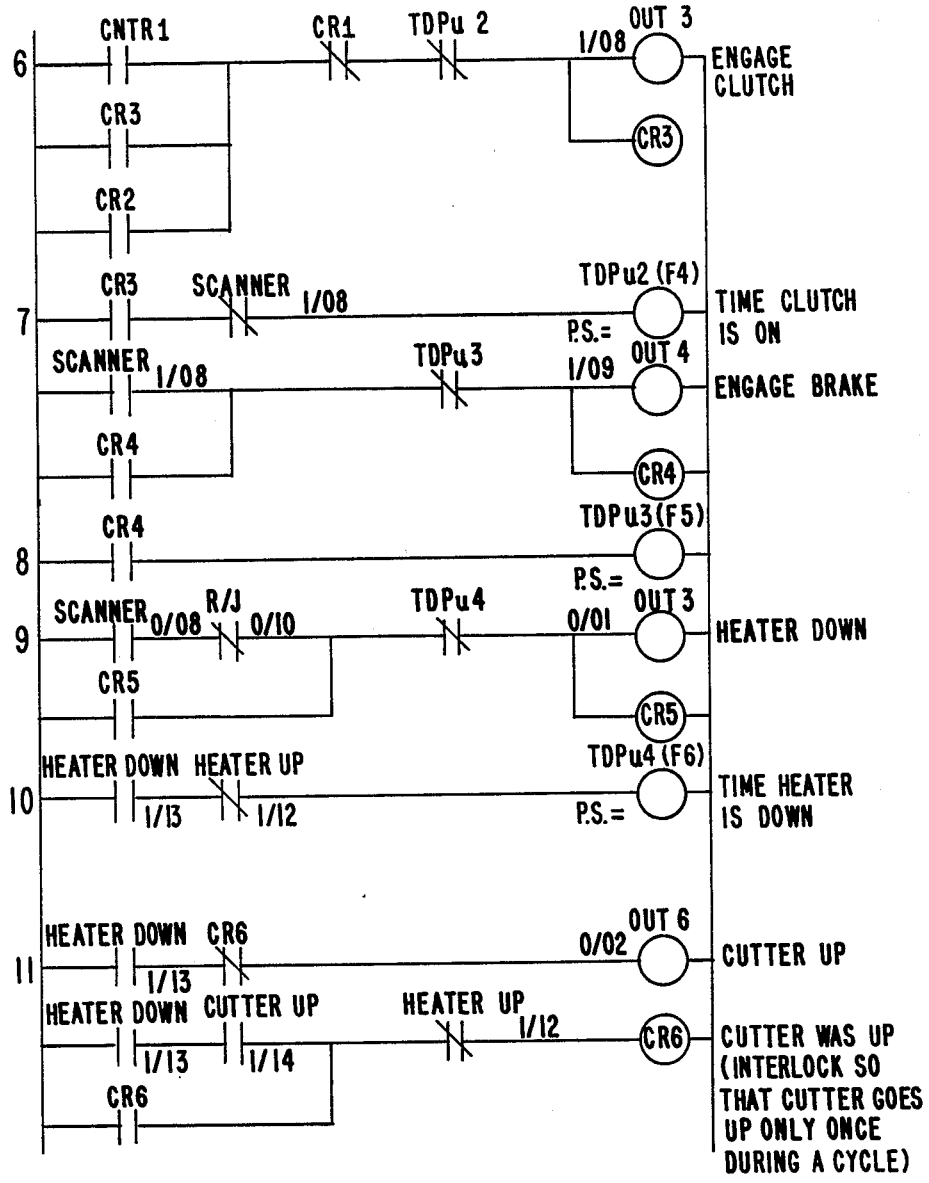
Figure 7:
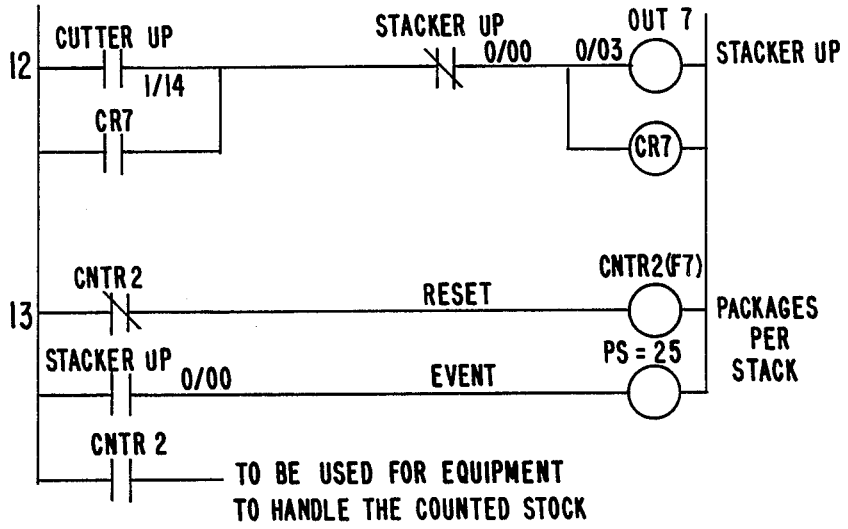

Referring now to FIGS. 5 through 7, the electrical schematic is shown and the beginning environment is as follows: The sponge making machine 10 is in operation and the lay up paddle or arm 19 is in the home position and the clutch/brake mechanism 36 is in the brake mode. The sealing platen 32 is in the up or home position and the knife 34 is in the down or home position as is the individual gauze package stacking tray 39. The feed rolls 26, 27 and 28, 29 are pressurized and the scanner is sensing the white area of the web of packaging paper for position control marks to stop the feed rolls 26, 27 and 28, 29. To set the paper register, the rotate switch 40 is set to jog position, the jog button is pressed at which time the clutch 36 will engage the drive rolls 26, 27 and 28, 29, and will move the packaging paper under the scanner 30 until an index mark on the paper triggers the scanner to engage the brake 36. The paper location is then inspected relative to shear cut edge. The location of the scanner 30 is adjusted with respect to the machine braking point. The jog cycle is repeated until the register is correct.

Now as to the run cycle, the rotate (jog-run) switch is turned to the run position at which time the lay up paddle 19 will place a gauze sponge 18 in collector box 20 on top of pocket 17.

A program controller counter is energized and will count two paddle placements signifying that two sponges 18 have been placed in the collector box 20. When the lay up paddle 19 places the second gauze sponge in the box 20, the program controller will simultaneously open the trap door 21 and begin the timing cycle for the sponge drop. After the time cycle is complete the program controller will simultaneously cause the trap door 21 to close and engage the clutch of the clutch/brake unit 36, driving paper through the unit.

The scanner 30 senses a register mark on the web of paper as it is fed by. The program controller then engages the brake 36 and at the same time energizes a solenoid to move the sealing platen 32 downwardly.

As the sealing platen 32 approaches the down position a proximity sensor senses platen location and the program controller simultaneously starts the time cycle for sealing and energizes the solenoid to actuate the guillotine knife 34. After the time cycle is complete the controller will cause the sealing platen 32 to return to its home position. As the knife moves upward through the paper a proximity sensor senses knife location and the program controller energizes the solenoid to move the stacker tray 39 upward. When the knife and stacker cylinders reach their limits they are returned to the home position.

The many advantages of the foregoing packaging machine are that (a) it is driven by the sponge making machine; (b) it is easily convertible for use with different size sponges or other products; (c) it requires a minimum of space; (d) it provides automatic quality inspection for miscounts of sponges in the seal area and rejection of defective packages; (e) it can be used with hot or cold seal packaging materials; (f) it can be easily detached from the sponge making machine for bulk packing of sponges; and (g) it requires fewer operators.

While the foregoing describes the apparatus in great detail it is important to note that the method of the present invention is also regarded as important to the carrying out of the invention, which method of manufacturing packaged deformable surgical sponges of a shape generally disposed in a flat plane with a stacked array thereof contained between two webs of packaging material comprises the steps of: first forming the sponge articles in a machine, delivering a fixed number of at least two of the sponges from the forming machine in a stacked array with the planes of the articles vertically disposed in a side-by-side relationship, two webs of the packaging material are converged into a substantially V-shaped vertically disposed reception slot adapted to receive the stacked array of sponges. Thereafter the stacked array of sponges are dropped vertically into the reception slot so that the stacked array is substantially wedged therebetween.

The webs of packaging material are synchronously moved a distance toward the slot to form a pocket between the webs as the stacked array of sponges is received thereinto for moving the stacked array away from said slot and for containing and packaging the stacked array and stopping the webs to receive the stacked array and stopping the webs to receive a further stacked array of sponges between the webs, thereafter, the webs are sealed about the stacked array of sponges to form a package, and the web between stacked arrays of sponges is cut to form individual packages.

What we claim is:

1. The method of manufacturing packaged deformable articles of a shape in which the articles have major faces that are generally disposed in a flat plane with a stacked array thereof contained between two webs of packaging material, comprising the steps of:

forming the articles in a machine, delivering a fixed number of at least two of the articles from the machine in a stacked array with major faces of the articles vertically disposed in a side-by-side, contacting relationship, converging two webs of the packaging material into a substantially V-shaped, vertically disposed reception slot defining a pocket open in an upward direction and adapted to receive the stacked array, dropping the stacked array vertically downwardly into the reception slot so that the stacked array is substantially wedged therebetween, synchronously moving the webs of packaging material as the stacked array is received thereinto for moving the stacked array away from said slot while the array is between the webs and for containing and holding said stacked array as a unit, sealing the webs together about the stacked array therebetween to form a sealed package, and separating the sealed webs between successive stacked arrays to form individual sealed packages containing a plurality of the deformable articles in side-by-side relationship.

2. The method of manufacturing packaged sterile medical gauze sponges of a shape in which the sponges have major faces that are generally disposed in a flat plane with a stacked array thereof between two webs of packaging material, comprising the steps of:

forming the medical sponge articles in a machine, delivering a fixed number of at least two of the medical gauze sponges from the machine to an assembly station in a stacked array with major faces of the articles vertically disposed in a side-by-side, contacting relationship, converging two webs of the packaging material into a substantially V-shaped, vertically disposed reception slot beneath said assembly station, said seat being open in an upward direction, dropping the stacked array of sponges vertically downwardly into the reception slot so that the stacked array is substantially wedged therebetween without disturbing their exact geometric adjacent alignment, synchronously moving the webs of packaging material as the stacked array of sponges is received thereinto for moving the stacked array of sponges away from said slot while the array is between the webs and for containing and holding said array of sponges as a unit, sealing the webs of packaging material together about the stacked array of medical sponges therebetween to form a sealed, sterile package, and separating the sealed webs between successive stacked arrays to form individual sealed packages containing a plurality of the medical sponges in side-by-side relationship.

3. For use with a medical sponge making machine having discharge conveyors and tote boxes for completed sponges; a packaging machine for receiving completed sponges from said sponge making machine, said packaging machine comprising: a sponge assembling station having a lay up paddle positioned to receive completed sponges from the discharge conveyor of said sponge making machine, holder means for receiving sponges fed by said lay up paddle and for retaining said sponges in side-by-side relationship, a trap door in the bottom of said holder means upon which at least two sponges are placed by said lay up paddle to define a stacked array, means connected to said trap door to open said trap door upon placement of at least a second sponge in said holder means and against said trap door, means carried by said packaging machine for converging two webs of packaging material into substantially a V-shaped, vertically disposed reception slot beneath said trap door and open in an upwardly facing direction for receiving the stacked array of sponges upon opening of the trap door, means carried by said packaging machine connected to engage and move the webs of packaging material containing the stacked array of medical sponges away from said sponge assembling station while the stacked array is maintained as a unit to clear the V-shaped, vertically disposed slot formed beneath the closed trap door for receiving another array of sponges, means moving said webs and a stacked array of sponges therebetween away from said sponge assembling station and advancing them to a sealing station where the webs about the stacked array are sealed together to form a sealed package containing said stacked array, and shearing means positioned to shear the webs between spaced, successive packages when seals have been effected about the array of surgical sponges.

4. Apparatus for packaging medical sponges having major faces of a shape generally disposed in a flat plane with a stacked array thereof between two webs of packaging material, said apparatus comprising: a sponge supplying machine for supplying a continuous supply of medical sponges, means cooperatively related to said apparatus and positioned to receive sponges from said sponge supplying machine and for delivering a fixed number of at least two of the medical sponges from the supplying machine to an assembly station of a packaging machine and in a stacked array with the major faces of said sponges vertically disposed in side-by-side relationship, means carried by said apparatus positioned beneath said assembly station for converging two webs of packaging material into a substantially V-shaped, vertically disposed reception slot open in an upward direction and adapted to receive the stacked array of sponges, means at the bottom of said assembly station for dropping the stacked array of sponges vertically downwardly into said V-shaped slot so that the stacked array of sponges is substantially wedged between said two webs of packaging material while the sponges are maintained with their major faces in side-by-side relationship, means carried by said apparatus and contacting said webs of packaging material for synchronously moving the webs of packaging material as the stacked array of sponges is received thereinto for moving the webs and stacked array and for containing and holding said stacked array in a sanitary pack, sealing station means positioned downstream of said assembly station and positioned to engage the webs about the stacked arrays of medical sponges to form sealed, sanitary packages of sponges, and shearing station means downstream of said sealing station means for shearing the webs between successive individually sealed packaged stacked arrays of medical sponges into individual packages.

5. Apparatus for packaging medical sponges of a shape generally disposed in a flat plane with a stacked array thereof between two webs of packaging material, said apparatus comprising: a sponge supplying machine for supplying a continuous supply of medical sponges; means cooperatively related to said packaging apparatus and positioned to receive sponges from said sponge supplying machine and to deliver a fixed number of at least two of the medical sponges from the supply machine to an assembly station of a packaging machine in a stacked array with the planes of said sponges vertically disposed in side-by-side relationship, said assembly station including a trap door to selectively retain and release an array of sponges; means carried by said apparatus positioned beneath said assembly station for converging two webs of packaging material into a substantially V-shaped, vertically disposed reception slot adapted to receive the stacked array of sponges; means at the bottom of said assembly station for dropping the stacked array of sponges vertically into said V-shaped slot so that the stacked array of sponges is substantially wedged between said two webs of packaging material; means carried by said apparatus and connected to said webs of packaging material for synchronously moving the webs of packaging material a distance toward the slot to form a pocket between the webs as the stacked array of sponges is received thereinto for moving the stacked array from said slot and for containing and packaging said stacked array in a sanitary pack and stopping the webs to receive a further stacked array between the webs; sealing station means positioned downstream of said assembly station carried by the machine and positioned to engage the webs about the stacked arrays of medical sponges to form sanitary package of sponges; shearing station means carried by the machine downstream of said sealing station means forming the packaged array of sponges for shearing the web between individually sealed, packaged, stacked arrays of medical sponges into individual packages; time actuated means connected to open the trap door upon placement of a last sponge against a previous sponge at the assembly station; means for closing the trap door after the sponges have fallen into the V-shaped, vertically disposed slot for receiving more sponges at said assembly station; means for driving the two webs of packaging material with the array of sponges therebetween to the sealing station means; scanner means carried by said machine and positioned above the webs of packaging material and their contained array of sponges responsive to index markings on one of the webs to stop movement of the webs when the array of sponges have arrived at registration with the sealing station means; actuating means for actuating the sealing station means to form a sealed package of at least two sponges; and means connected to actuate the shearing station means when the sealing station means has completed sealing the webs to define a packaged array of medical sponges.

6. For use with a medical sponge making machine having at least one sponge delivery chute for completed sponges having major faces that are substantially planar, and having a machine drive take-off; a medical sponge packaging machine comprising:

means for assembling at least two surgical sponges in a stacked array with the planar major faces of said at least two sponges disposed vertically in a side-by-side, contacting relationship at a sponge assembly station, means converging two webs of packaging material into a substantially V-shaped vertically disposed slot beneath said stacked array of at least two sponges, said slot having an opening facing in an upward direction, means at the bottom of said sponge assembly station for supporting the array of sponges, sponge release means for dropping the stacked array of sponges vertically downwardly into the vertically disposed V-shaped slot between the webs and without disturbing the alignment of the sponges in the array, synchronous drive means positioned to move the webs of packaging material and the array of sponges therebetween away from the sponge assembly station to receive a further stacked array of sponges between said webs, said stacked arrays being spaced from each other, sealing means downstream from said sponge release means positioned in the line of travel of said webs to form a containment seal between said webs and about the array of sponges to provide a sealed package of sanitary medical sponges, and shearing means for separating the packaged arrays of sponges from one another downstream of said sealing means to form individual packets of stacked arrays of medical sponges.

7. A packaging machine as claimed in claim 6, further comprising vertically disposed stacking tray means positioned to receive the individual packets of stacked arrays of sponges downstream of said shearing means.

8. A packaging machine as claimed in claim 6, further comprising drive means carried by said packaging machine and adapted to be connected to a sponge making machine drive take-off means so that the packaging machine can be driven together with and added to a sponge making machine to permit the bulk packaging of sponges.

9. In a machine for manufacturing sponges or like articles, a transfer mechanism for receiving and counting a plurality of sponges having major faces that are substantially planar with their planes vertically disposed and in side-by-side contact with each other to form a stacked array, means for releasing the stacked array of sponges to fall vertically into a reception station, means for forming at the reception station a V-shaped slot from two webs of packaging material to receive the stacked array therebetween, and means for moving the webs of packaging material and sponge stacked array to a package forming means for forming a sealed package containing said array of sponges in side-by-side relationship.

10. A machine as claimed in claim 9, wherein the package forming means comprises a sealing means conforming to the outline form of the array of sponges for establishing a containment seal about the array of sponges to define a sponge package with the sponges in the stacked array.

11. A machine as claimed in claim 10, further comprising means for separating a line of successive, spaced sponge packages into individual sponge packages.

* * * * *